United States Patent [19]

Lowe

[11] Patent Number: 4,519,311

[45] Date of Patent: May 28, 1985

[54] AUXILIARY PRINTING DEVICE FOR A POSTAGE METER

[75] Inventor: Lynnwood Lowe, Darien, Conn.

[73] Assignee: Pitney Bowes Inc., Stamford, Conn.

[21] Appl. No.: 475,775

[22] Filed: Mar. 16, 1983

[51] Int. Cl.[3] ..... B41J 1/60

[52] U.S. Cl. ..... 101/109; 101/45; 101/91; 101/93; 101/287

[58] Field of Search ..... 101/18, 29, 42, 45, 101/59, 66, 68, 69, 91, 92, 93, 93.11, 93.12, 93.41, 93.42, 109, 110, 287

[56] References Cited

U.S. PATENT DOCUMENTS

| | | | |
|---|---|---|---|
| 578,423 | 3/1897 | Richardson | 101/109 |
| 2,179,269 | 11/1939 | Ogden | 101/91 |
| 4,314,505 | 2/1982 | Krembel, Jr. | 101/29 |
| 4,326,460 | 4/1982 | Nückel | 101/93.12 |
| 4,418,618 | 12/1983 | Huggins et al. | 101/68 |

FOREIGN PATENT DOCUMENTS

| | | | |
|---|---|---|---|
| 71750 | 11/1950 | Denmark | 101/29 |
| 319110 | 12/1969 | Sweden | 101/109 |

*Primary Examiner*—Clifford D. Crowder
*Assistant Examiner*—David A. Wiecking
*Attorney, Agent, or Firm*—Robert E. Meyer; William D. Soltow, Jr.; Albert W. Scribner

[57] ABSTRACT

In a postage meter, an auxiliary printing device is included for printing additional information on a mail piece relating to the type of mail being processed. The postage meter is of the flat printing type and a multi-faced printing member containing the additional information to be printed is mounted adjacent the standard postal printing mechanism. Each of the faces of the printing member may contain postal information to be printed and the appropriate information may be selected by rotating a handle attached to the member. A detent means aligns the selected printing face with the rest of the postage meter printing die. The detent means may be manually released from the printing member to remove the member from the postage meter.

4 Claims, 3 Drawing Figures

AUXILIARY PRINTING DEVICE FOR A POSTAGE METER

BACKGROUND OF THE INVENTION

This invention relates to postage meters which are devices used to imprint postal indicia on an article to be mailed and for recording the value of the postage printed. The printed postal indicia generally consists of a fixed design within which a selectable value of postage is contained. The indicia may also contain the date of mailing. An advertising or public service message may also be printed by the meter alongside the postal indicia.

Two types of printing mechanisms have been used in postage meters. One is a rotary printing mechanism which is generally used where high printing speeds are required and the other is a flat type printing mechanism which is generally lower in cost due to the absence of rotary parts. The printing of the postal indicia is done either directly on the envelope to be mailed or on a paper tape which can then be affixed to larger parcels. Pitney Bowes Inc. of Stamford, Conn. manufactures postage meters of each printing type; the Model 5300 being a rotary printing meter, while the Model 5700 is a flat printing meter.

In some countries, government postal regulations require additional data to be imprinted along with the postal indicia to identify the type of mailing being done (i.e., air mail, newspaper, books, etc.). The present invention relates to an auxiliary printing member to print this additional data along with the postal indicia. U.S. Pat. No. 4,326,460 to Klaus Nuckel discloses such an auxiliary printing member in a rotary printing postage meter. The present invention relates more specifically to an auxiliary printing member for use in a flat printing type postage meter.

Therefore, it is an object of the present invention to provide an auxiliary printing member in a postage meter to print additional data alongside the standard flat printing postal indicia.

Another object is to provide means to select one of a number of mail identification data to be printed by the auxiliary printer.

Another object is to provide means to easily remove the auxiliary printer for substitution by another printer having a different set of mail identification data thereon.

Yet another object is to provide mounting means for the auxiliary printer so as to allow the printing surface to automatically adjust to an uneven surface that may be encountered in the mail that is presented to the meter for imprinting.

SUMMARY OF THE INVENTION

The present invention is a postage meter of the flat bed printing type which includes a fixed printing indicia and a selectable value printing indicia mounted in the meter frame and a reciprocating platen to apply the postal article against both indicias to simultaneously print a complete postal impression. The postage meter includes a multi-faced auxiliary printing member which has additional postage identification data indicia on at least one face thereof. The auxiliary printing member is located adjacent the fixed indicia and rotatably mounted in the meter frame. A detent means is used to align each face of the member in a coplaner relationship with the fixed indicia. Attached to the front of the printing member is a handle to permit the member to be rotated so that a printing face can be selected and positioned in a printing position. A tab is included on the detent means to release the detent from engagement with the printing member so as to permit removal of the printing member from the meter. In one embodiment, the printing member may have an elongated square shape to provide four faces on which postal information data to be printed can be located. Further, the detent means can be overcome by the printing force of the reciprocating platen so that the printing member can rotatably shift to automatically compensate for differences in thickness encountered in the postal article being imprinted.

DETAILED DESCRIPTION OF THE PREFERRED EMBODIMENT

Figure 1:
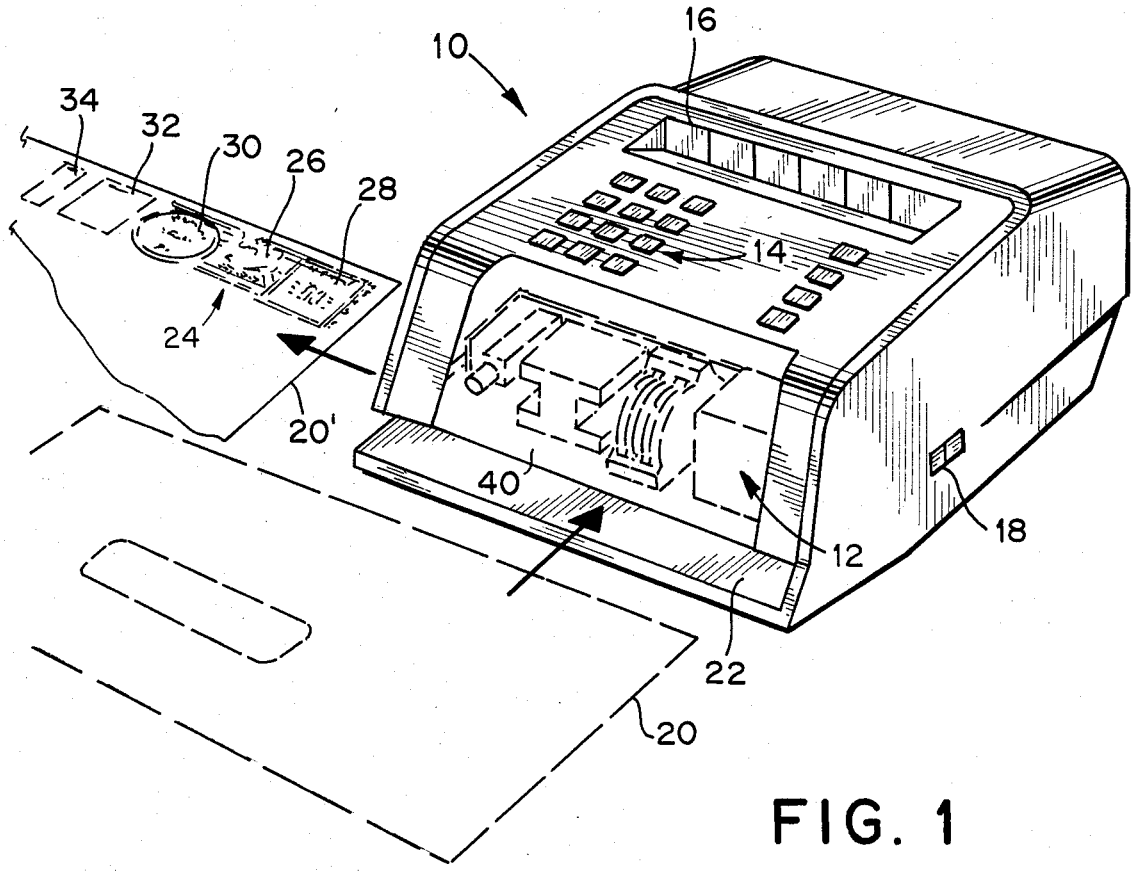
FIG. 1 is an isometric view of a postage meter embodying the present invention.

Referring to FIG. 1, a postage meter 10 embodying the present invention is shown. The meter 10 is of a flat bed printing type containing printing means to print a postal indicia on a mailing piece; a selection mechanism to select the amount of postage desired to be imprinted; and a register to keep an accurate account of the value of postage imprinted. The printing mechanism 12 is located in the front portion of the meter. A keyboard 14 on the top of the meter is used by the operator to control the selection mechanism (not shown) to select the proper value of postage desired to be imprinted. A display window 16 indicates to the operator the value of postage that has been selected and may also be used to show the amount of postage remaining in the meter. To operate the meter, the operator turns the meter on using the on/off switch 18, selects the desired postage value using the keyboard 14, which value is then displayed in the window 16. An envelope 20 to be imprinted with postage is inserted into an opening 22 in the lower front portion of the meter. When the envelope is fully inserted, a cycle of the meter is initiated during which time the postal indicia is printed on the envelope and the value of the postage imprinted is recorded in the registers of the postage meter. The printing is accomplished by a reciprocating platen 21 located in the opening 22 opposite the printing surface. The platen rises, presses the envelope against the printing surface and then retracts. When the printing has been completed, the envelope is ejected from the meter.

The postal indicia 24 that is shown imprinted on the envelope 20' consists of a number of parts. The main part is a postal design 26 which is approved by the government providing the postal service. Within this design is a value printing area 28 in which the actual amount of postage is printed, and a date printing area 30 which, when required by postal regulations, is used to imprint the date on which the mailing is taking place. Adjacent to the postal indicia 24 is an area 32 which may be used to imprint an advertising or public service message at the option of the user of the postage meter. Next to the advertising area 32 is an area 34 that may be used, where required, to imprint information regarding the type of mailing upon which the postal imprint is being made (for example, air mail, book rate, newspapers, etc.).

Figure 2:
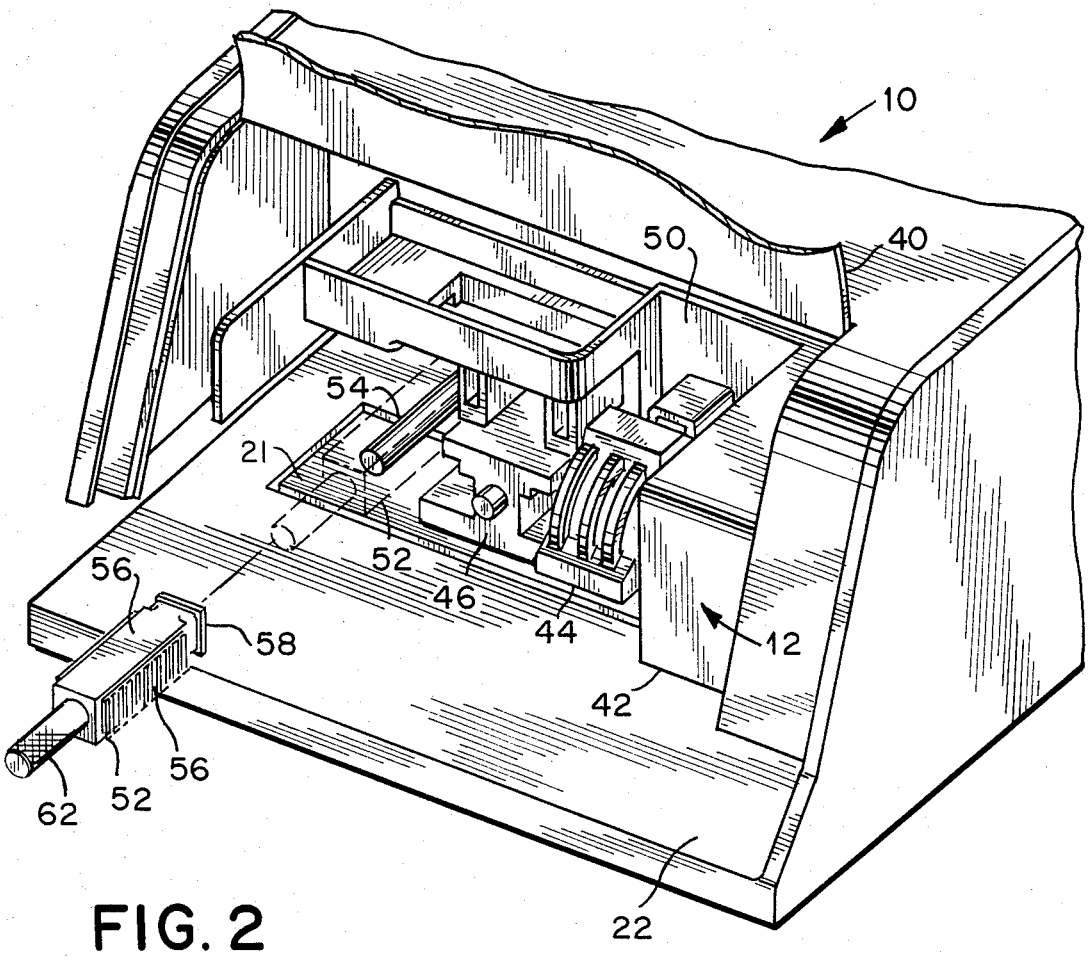
FIG. 2 is an enlarged view of the front portion of the postage meter shown in FIG. 1.

Referring now to FIG. 2, the various portions of the printing mechanism 12 for printing the postal indicia 24 are shown in the front portion of the meter 10. A door 40 in the front portion of the meter 10 may be opened to gain access to portions of the printing mechanism for setting or replacement. The value printing area and the mechanism for printing variable postage amounts are located within a secure housing 42 because there is never any time the operator needs to have access to this area, and in fact, providing such access would compromise the security of the meter. However, under the postal regulations of many countries, for certain types of mail, it is necessary for the operator to set the date to be printed by the meter and therefore a date selection mechanism 44 is provided to set the date printing wheels in the postal indicia. The advertising printing plate 46 is located adjacent the date selection mechanism 44 and is mounted on rails attached to the front frame 50 of the meter. The advertising plate 46 may be removed if it is desired not to print such advertising by simply sliding the plate towards the front of the meter. Located adjacent to the advertising plate 46 is the auxiliary printer 52 for printing additional postage data information. In FIG. 2, the printer 52 is shown in its operating position by phantom lines while it is also shown in full lines withdrawn from the meter 10 for clarity.

The auxiliary printer 52 has an elongated square shape so that each of the four faces 56 may be used for different postal information data. A hole is provided into the rear surface 58 of the printer 52 so that the printer may be inserted over a shaft 54 extending from the postage meter frame 50. Attached to the front of the printer 52 is a handle 62 to be used for positioning the printing member 52 into the meter.

Figure 3:
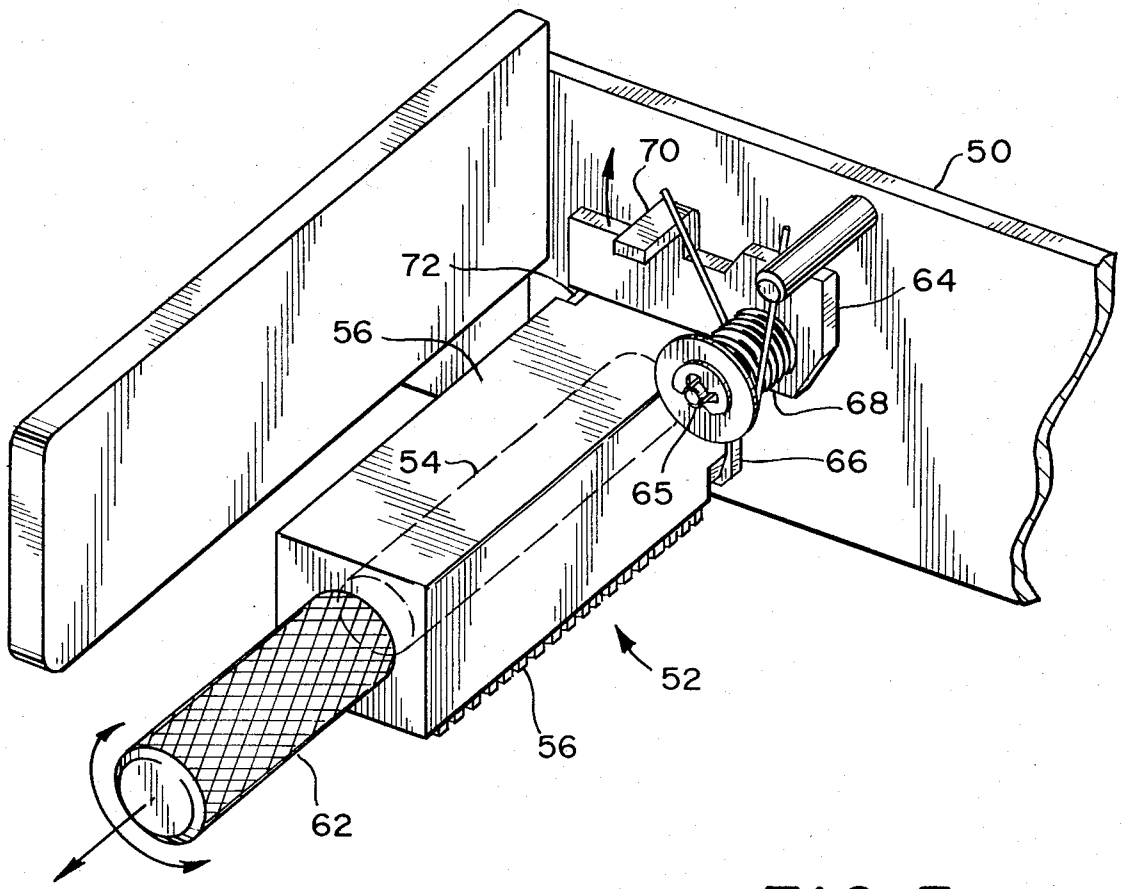
FIG. 3 is an enlarged view of the auxiliary printing device.

As best seen in FIG. 3, a detent arm 64 is pivotably mounted on shaft 65 to align and retain the auxiliary printing member 52 in the proper position within the meter 10. The detent arm 64 engages against the flat face 56 of the printing member and thereby aligns the opposing side printing face with the other portions of the postal indicia. To prevent the printing member from withdrawing from the meter, a square plate 66 is attached to the rear of the printing member and has slightly larger dimensions than the square shape of the printing member. Therefore, when the detent arm 64 is engaged against the printing member, the flat plate 66 prevents the printing member from moving towards the front of the meter. A torsion spring 68 is also located on the shaft 65 to maintain the detent arm 64 in engagement with the printing member 52. The detent arm 64 has a tab 70 which extends toward the front of the meter to be used to release the detent arm from engagement with the printing member. To insert the auxiliary printing member into the meter, the operator grasps the member by the handle 62 and inserts the printing member over the shaft 54 while at the same time lifting the tab 70 on the detent arm to allow the printing member to be inserted to its full depth. The tab 70 is then released and the detent arm engages the printing member in front of the plate 66 to prevent the member 52 from being withdrawn. The operator may then select the proper printing information by simply rotating the handle 62 of the printing member until the proper face 56 is positioned in the printing position. If desired, one or more of the faces 56 of the printing member 52 may be left blank of printing information so that a non-printing position of the member 52 may be selected rather than removing the member from the meter when printing such postal information data is not required. To make the rotation of the printing member 52 easier, a partial groove 72 has been cut into the portion of the printing member 52 adjacent to the plate 66 and in line with the detent arm 64. The groove is cut only to a depth which removes a portion of the square corners of the member 52 while still leaving a flat portion on each side 56 to engage the detent arm 64.

Occasionally, the contents of an envelope may not be of uniform thickness which may result in portions of the postal indicia being clearly printed while other portions are not because of the different thicknesses of material in the envelope. Much of this problem is avoided, however, with the mounting that is used for the present auxiliary printer. Should the printer encounter various thicknesses in its printing area, the forces developed by the reciprocating platen to press the envelope against the printing face 56 will overcome the detent arm 64 allowing the printing member to rotate slightly and automatically adjust itself to the best printing angle against the uneven contents of the envelope.

I claim:

1. In a postage meter of the flat bed printing type having a fixed printing indicia and at least one selectable value printing indicia, both said indicias being mounted on the meter frame and a reciprocating platen to apply a postal article against both said indicias so as to simultaneously print a complete postal impression; the improvement comprising:

(a) a multi-faced auxiliary printing member having additional postage identification data indicia on at least one of said faces, said member being rotatably mounted about an axis fixed in said meter frame and located adjacent said fixed indicia;

(b) detent means engagable with said printing member for aligning said indicia on said one of said faces of said printing member in a coplaner relationship with said fixed indicia after rotation thereof about said axis, said detent means further serving to retain said printing member on said axis and in said postage meter, and, (c) a handle member attached to said multi-faced printing member to manually rotate said multi-faced printing member and select a face of said member and position said selected face in said coplaner relationship with said fixed indicia.

2. The improved postage meter of claim 1 wherein said detent means further comprises a tab for releasing said detent means from engagement with said printing member and permitting said multi-faced printing member to be removed from said meter frame.

3. The improved postage meter of claim 1 wherein said printing member has an elongated square shape and each of the four faces may contain postal information data to be imprinted.

4. The improved postage meter of claim 1 wherein said detent means can be overcome by the force of said reciprocating platen during the printing cycle whereby said printing member will seek a printing plane corresponding to the plane presented by the contents of the postal article being imprinted.

* * * * *